United States Patent [19]

England

[11] Patent Number: 5,023,514

[45] Date of Patent: Jun. 11, 1991

[54] COAXIAL MAGNETRONS WITH DIELECTRICALLY LOADED OUTPUT CAVITY

[75] Inventor: Melvin G. England, Ashford Common, England

[73] Assignee: Thorn Microwave Devices Limited, Hayes, England

[21] Appl. No.: 339,731

[22] Filed: Apr. 18, 1989

[30] Foreign Application Priority Data

Apr. 19, 1988 [GB] United Kingdom ..... 8809218

[51] Int. Cl.[5] ..... H01J 25/55

[52] U.S. Cl. ..... 315/39.51; 315/39.77

[58] Field of Search ..... 315/39.51, 39.57, 39.75, 315/5.13, 39.65, 39.77

[56] References Cited

U.S. PATENT DOCUMENTS 2,655,616 10/1953 Rollin ..... 315/39.51
3,069,594 12/1962 Feinstein ..... 315/39.75 X
3,412,285 11/1968 Gerard ..... 315/39.61
3,435,284 3/1969 Downing et al. ..... 315/39.77 X
3,899,715 8/1975 Esteron et al. ..... 315/39.77 X
4,588,965 5/1986 Cook ..... 331/91

FOREIGN PATENT DOCUMENTS 1445346 8/1976 United Kingdom .
1453805 10/1976 United Kingdom .
1470417 7/1980 United Kingdom .

*Primary Examiner*—Eugene R. LaRoche
*Assistant Examiner*—Benny T. Lee
*Attorney, Agent, or Firm*—Fleit, Jacobson, Cohn, Price, Holman & Stern

[57] ABSTRACT

A coaxial magnetron incorporates a quantity of dielectric material within the coaxial cavity between the resonant cavity and the outer wall of the magnetron. The dielectric material has sufficiently high relative permittivity, and Q factor, and is provided in sufficient quantity that the size of the cavity may be reduced for a given frequency and power output.

5 Claims, 1 Drawing Sheet

COAXIAL MAGNETRONS WITH DIELECTRICALLY LOADED OUTPUT CAVITY

This invention relates to coaxial magnetrons.

Figure 1:
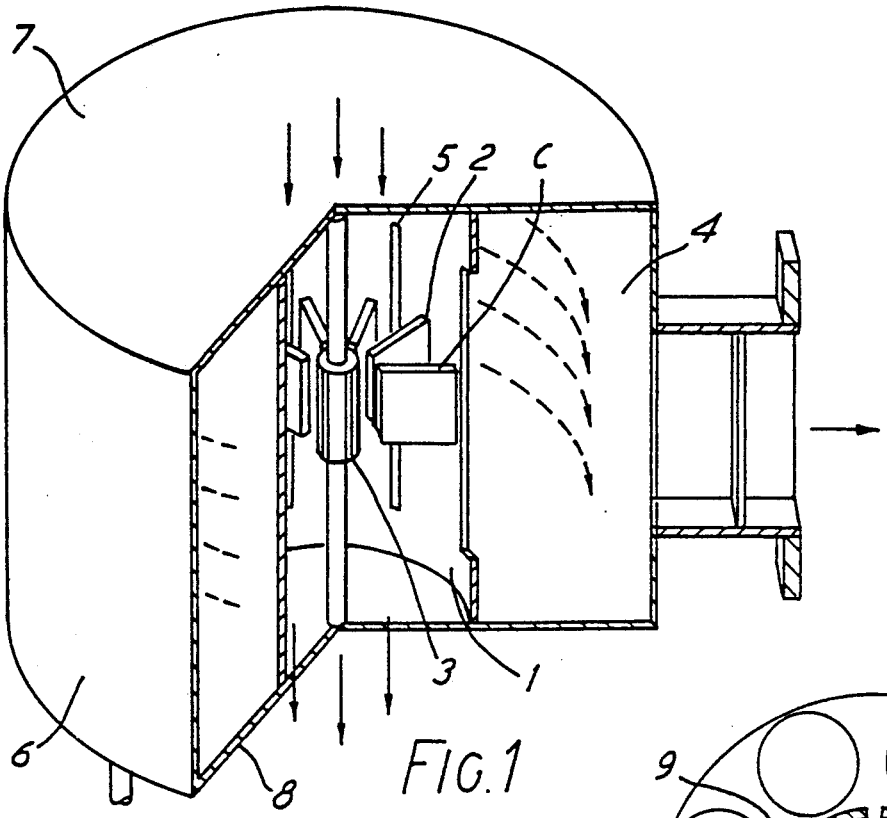
Figure 2:
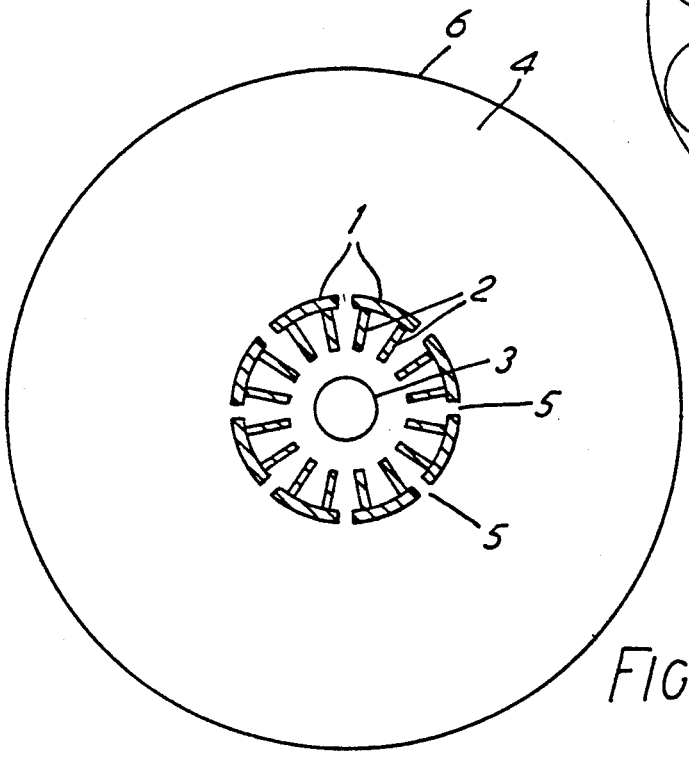

FIG. 1 of the accompanying drawings illustrates, schematically a cut-away, perspective view of a known coaxial magnetron, and FIG. 2 shows a transverse cross-sectional view through such a coaxial magnetron.

A coaxial magnetron typically comprises a cylindrical anode wall 1 having regularly spaced anode vanes 2 which extend radially inwards towards a cathode 3 located on the longitudinal axis of the magnetron. The region between each pair of adjacent anode vanes defines a respective resonant cavity (e.g. C) which is coupled to an outer, coaxial cavity 4 via a respective slot 5 in the anode wall 1. The outer cavity 4 is bounded by the anode wall 1, a coaxial outer wall 6 and two end-plates 7, 8.

As will be apparent from FIG. 2 the outer, coaxial cavity 4 occupies a major proportion of the total magnetron volume and, for a typical example, the diameters of the anode wall 1 and the outer wall 4 may be in the ratio 1:3, the volumes bounded by walls 1 and 6 respectively being in ratio 1:9. A reduction of magnetron size (and weight) would be desirable in many applications.

An object of the present invention is to provide a coaxial magnetron which occupies a significantly reduced volume as compared with coaxial magnetrons of conventional construction.

Accordingly there is provided a coaxial magnetron comprising a cathode arranged on a longitudinal axis of the magnetron; a coaxial anode wall having a plurality of anode vanes arranged at regular intervals around, and extending radially inwards towards said cathode, the region between each pair of adjacent anode vanes defining a respective resonant cavity; a coaxial cavity coupled to each said resonant cavity by a respective slot in the anode wall; and a quantity of a dielectric material within said coaxial cavity, the quantity having a substantially fixed position and orientation within the cavity.

For a given resonant frequency and power output, the coaxial cavity may then occupy a much smaller volume than if said dielectric material had been absent.

Preferably the Quality (Q) - factor of said dielectric material is greater than about $10^3$.

The relative permittivity (k) of the dielectric material should be as large as practically realizable; preferably in excess of 30. The dielectric material may be a ceramic material.

In order to promote consistent operation during the lifetime of the magnetron, the quantity of dielectric material should preferably be so distributed within said coaxial cavity as to be substantially shielded, in operation of the magnetron, from cathode emission products.

The quantity of dielectric material may comprise a plurality of rods arranged at different angular positions around said longitudinal axis and each rod may be positioned intermediate a respective pair of adjacent slots. For greater effect there should be a rod intermediate each adjacent pair of slots.

Figure 3:
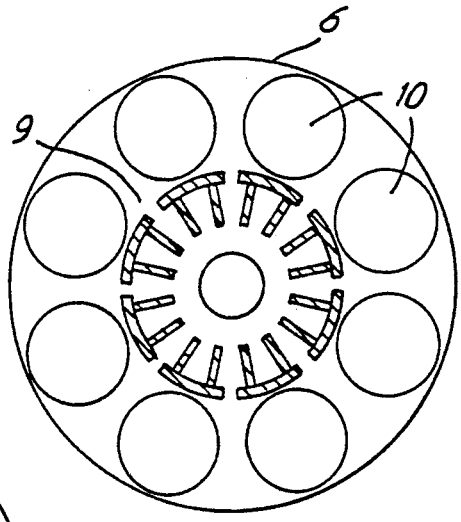

In order that the invention may be carried readily into effect a embodiment thereof is now described, by way of example only, by reference to the accompanying drawings of which:

FIG. 1 shows schematically, a cut-away perspective view of a known coaxial magnetron, FIG. 2 shows a transverse, cross-sectional view through a known coaxial magnetron and FIG. 3 shows a transverse, cross-sectional view through a coaxial magnetron in accordance with the present invention.

FIG. 3 of the drawings shows a transverse, cross-sectional view through a coaxial magnetron having a cathode 3 and an anode structure 9 (i.e. anode wall 1, anode vanes 2 and slots 5) which are identical to corresponding components of the magnetron shown in FIG. 2. In contrast, however, coaxial cavity 4 is of greatly reduced size, and this is made possible, in accordance with the invention, by provision of a quantity of a dielectric material within the coaxial cavity.

In this embodiment of the invention, the quantity of dielectric material is in the form of eight cylindrical rods 10, arranged at regular intervals around the longitudinal axis of the magnetron. The rods 10 are mounted from the end-plate 8 (shown more clearly in FIG. 1), such that each rod has a substantially fixed position and orientation within the cavity 4.

A comparison of FIGS. 2 and 3, which are drawn on the same scale, shows that the diameter of cavity 4 has been reduced by a factor 2/3, the volume of the magnetron being reduced by a factor 4/9.

An even greater reduction can be achieved by filling a larger proportion of the available volume. It is preferable, however, that the dielectric material be so distributed within the cavity as to be substantially shielded from cathode emission products which tend to penetrate slots 5 in the anode wall when the magnetron is in operation. Such emission Products might otherwise accumulate on the dielectric material causing a gradual change of relative permittivity and a consequent reduction of the effective life of the magnetron. In this embodiment, therefore, each rod 10 is positioned, as shown, intermediate an adjacent pair of slots and is thereby substantially shielded from emission products which pass therethrough.

Preferably the dielectric material used should have a relative permittivity (k) which is as large as is practically realizable and the Quality (Q)-factor of the material should preferably be in excess of $10^3$.

Some ceramic dielectric materials are found to be especially suitable. Examples of such ceramic dielectric materials are listed in Table 1, below, and are described in "Dielectric Resonators" by Darko Kajfez (Published by Artech House)

TABLE 1

| Material | | Q-Factor | k |
|---|---|---|---|
| Resonics M Series | $(Zr,Sn)TiO_4$ | $1.5 \times 10^4$ | 37–39 |
| Resonics X Series | $Ba(Zr,Zn,Ta)O_3$ | $1.0 \times 10^4$ | 30–31 |
| Trans-tech | $Ba\ Ti_4O_9$ | $1.0 \times 10^4$ | 38.6 |

Materials having higher Q factors or permittivities may of course be used, for example Titanium oxide.

It will be understood that the quantity of dielectric material need not necessarily be provided as a number of cylindrical rods, as illustrated in FIG. 3. The present invention embraces other configurations, for example rods or bars of rectangular or square cross-section, or an integral structure, formed, for example, as a molding.

Furthermore, coaxial cavity 4 need not have the cylindrical form illustrated in FIG. 3. Alternatively, for example, outer wall 6 of cavity 4 maY conform more closely to the outwardly facing surfaces of rods 10. Wall 6 may, for example, consist of a number of identical elongate regions, each being concave (e.g. semi circular) in transverse cross-section and being located adjacent to a respective rod. This configuration leads to reduced distortion of the field distribution.

I claim:

1. A coaxial magnetron comprising a cathode arranged on a longitudinal axis of the magnetron; a coaxial anode wall surrounding the cathode and having a plurality of anode vanes arranged at regular intervals around, and extending radially inwards towards said cathode, the region between each pair of adjacent anode vanes defining a respective resonant cavity; a coaxial cavity surrounding all the resonant cavities and coupled to each said resonant cavity by a respective slot in the anode wall; and a quantity of a dielectric material disposed within said coaxial cavity, the quantity having a substantially fixed position and orientation with in the cavity, and wherein said quantity of dielectric material is so distributed within said coaxial cavity as to be substantially shielded, in operation of the magnetron, from cathode emission products.

2. A coaxial magnetron according to claim 1 wherein said quantity of dielectric material comprises a plurality of rods arranged at different angular positions around said longitudinal axis.

3. A coaxial magnetron according to claim 1 wherein said quantity of dielectric material comprises a plurality of rods arranged at different angular positions around said longitudinal axis.

4. A coaxial magnetron according to claim 3 wherein each said rod is positioned intermediate a respective pair of adjacent slots.

5. A coaxial magnetron according to claim 1 wherein said dielectric material has a Quality (Q)-factor in excess of $10^3$ and a relative permittivity in excess of 30.

* * * * *